US005083639A

United States Patent [19]

Kappeler

[11] Patent Number: 5,083,639

[45] Date of Patent: Jan. 28, 1992

[54] ACOUSTICAL SEAL FOR ELEVATOR CAR DOORS

[75] Inventor: Franz Kappeler, Urdorf, Switzerland

[73] Assignee: Inventio AG, Switzerland

[21] Appl. No.: 583,830

[22] Filed: Sep. 17, 1990

[30] Foreign Application Priority Data

Sep. 22, 1989 [CH] Switzerland ..... 3464/89

[51] Int. Cl.[5] ..... B66B 11/02

[52] U.S. Cl. ..... 187/51; 187/1 R; 187/56

[58] Field of Search ..... 187/DIG. 1, 1 R, 51, 187/52 R, 52 LC, 56

[56] References Cited

U.S. PATENT DOCUMENTS 3,425,162 2/1969 Halpern .
3,945,468 3/1976 Miura et al. ..... 187/1 R
4,058,191 11/1977 Balbo .
4,735,293 4/1988 Everhart et al. ..... 187/56

FOREIGN PATENT DOCUMENTS 52-62845 5/1977 Japan .
1-271391A 10/1989 Japan .
2-48392A 2/1990 Japan .
8302640 8/1983 PCT Int'l Appl. .
383582 1/1965 Switzerland .
432763 9/1967 Switzerland .

*Primary Examiner*—Joseph E. Valenza
*Assistant Examiner*—Dean A. Reichard
*Attorney, Agent, or Firm*—William J. Clemens

[57] ABSTRACT

An apparatus for sealing an automatic elevator door against sound closes the small air gaps between a door post and a door leaf rear edge, between an abutment and the door leaf top edge, between abutting front edges of door leaves, between an inner door leaf front edge and outer door leaf rear edge in the case of telescopic doors, and between a door sill and a door leaf bottom edge. A post seal utilizes an elastic strip seal to close the post air gap. An abutment seal utilizes a sliding brush seal to close the abutment air gap. A door sill seal utilizes a labyrinth seal to close the sill air gap. A door edge seal utilizes a brush seal to close the front edge air gap. These seals close all the air gaps around the door leaves when the door is closed to prevent the ingress of sound of the noises produced mechanically outside the car.

15 Claims, 3 Drawing Sheets

ACOUSTICAL SEAL FOR ELEVATOR CAR DOORS

BACKGROUND OF THE INVENTION

The present invention concerns an apparatus for sealing elevator car doors and, in particular, an acoustical seal for automaticly actuated doors on elevator cars.

The problem of sound damping exists in high speed elevator cars because the travel and air noises produced in the shaft increase proportionately with an increase in the speed of travel. These noises penetrate through every opening into the interior of the car and thus reduce the traveling comfort. Known methods of sound damping, such as utilizing damping material filling in the case of double-walled walls and doors, as well as quietly operating ventilation systems, are capable, together with vibration damping equipment, of achieving an appropriate effect. However, acoustic experiments show that even the smallest openings let a great deal of sound through. In relation to a door, this means that a door gap of, for example, one per cent of the entire door opening cross section lets one third to one half the sound volume produced outside the door through into the interior of the car.

In an automatic car door, there are a number of passages in the shape of small air gaps located between movable and fixed parts. These passages must be present in order to avoid direct frictional contacts. Such air gaps typically are present at the following locations: At the bottom of the door between the door sill and the door leaf lower edges, laterally between the door leaf surface and the entry side posts, between two door leaves in the case of telescopic doors, and at the top of the door between the entry abutment and the door leaf upper edge. A partial solution to this problem is to build the elevator car parts to narrow tolerances and use very accurate production and assembly operations in order to reduce these air gaps to a minimum amount. This is an expensive production method which does not entirely solve the problem.

It is disclosed in the U.S. Pat. No. 3,425,162 that this problem is usually ignored and that these air gaps are consequently not sealed off at all. The large passages which transmit sound, as mentioned above, are easily recognizable in the FIGS. 1 to 5 of this patent specification.

SUMMARY OF THE INVENTION

The present invention is based on the task of creating an acoustical sealing apparatus which is inexpensive to manufacture and eliminates the air gaps between the door and the elevator car entryway. This problem is solved by the present invention which seals the various different air gaps which no longer can act disadvantageously when the car door is closed. Furthermore, the apparatus according to the present invention can be installed at the time of manufacture of the elevator car or subsequently.

The present invention concerns an apparatus for sealing automatically actuated elevator car doors against the penetration of sound from outside the car, the car doors having horizontally moved door leaves which are guided and suspended by rollers and a rail at a top edge and guided by sliding guide members in a groove formed in a door sill at a bottom edge, and wherein the door leaves are moved by a door drive. The apparatus includes a plurality of dynamic sound proofing seals, each such seal attached to an associated edge of an elevator car door leaf and adapted to close one of a sill air gap, an abutment air gap, a post air gap and a front door edge air gap when the door leaf is in a closed position in an elevator car entryway.

The door sill seal includes at least one sealing strip extending across the entire width of the door leaf and adapted to extend downwardly into a groove formed in a door sill, and a guiding slide member attached to the one sealing strip and adapted to slidably engage walls of the groove, the sealing strip forming a labyrinth seal and adapted to close the sill air gap. The abutment seal has a row of bristles fastened on an upper edge of the door leaf and adapted to slide on a surface of the car, the abutment seal being adapted to close the abutment air gap. The post seal has an elastic sealing strip fastened at a rear edge of the door leaf and is adapted to abut a side post of the car, the post seal being adapted to close the post air gap. The door edge seal has a row of bristles fastened on a front edge of the door leaf and is adapted to interpenetrate bristles of a similar door edge seal fastened to an associated door leaf when the door leaves are in a closed position of the elevator door, the door edge seals being adapted to close the front door edge air gap.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
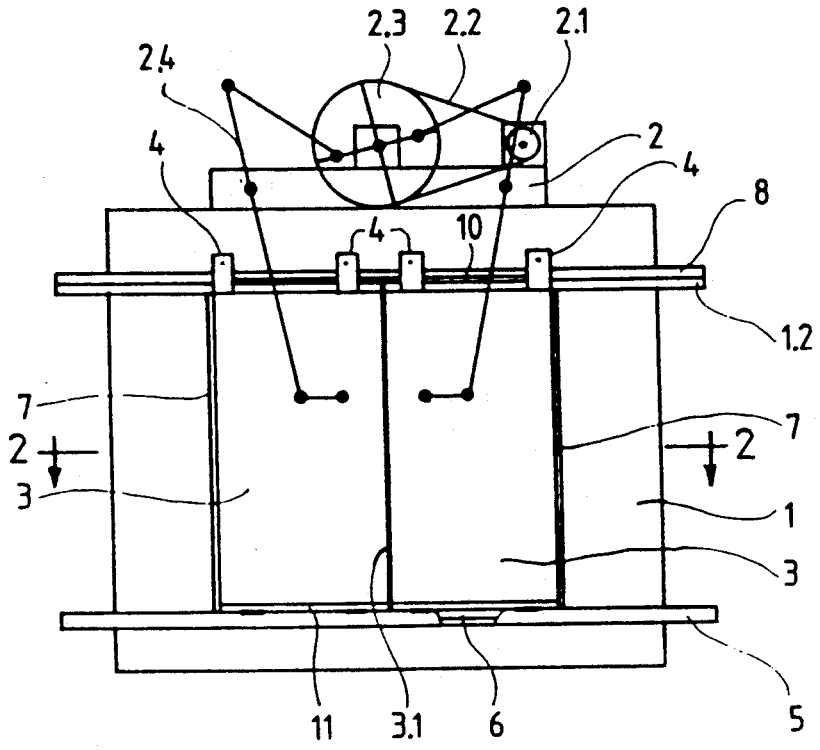
FIG. 1 is a front elevational view of an elevator car having an automatic car door incorporating acoustical seals in accordance with the present invention.

The FIG. 1 shows in front elevation an automatic door of an elevator car 1 having a door operator or drive 2 mounted on top of the car. The door drive 2 includes a door motor 2.1 driving in rotation, through a chain or belt 2.2, a crank wheel 2.3 which is attached to and operates a plurality of actuating levers 2.4 forming an operating linkage for a pair of door leaves 3. The door leaves 3 each have a vertically extending door edge air gap seal 3.1 attached to a front door edge facing a similar front door edge on the other leaf of the pair, are suspended from a top edge by door hangers 4 and are provided at a bottom edge with a door sill air gap seal 6. The door leaves 3 are connected to a rail 8 at the top edge by the hangers 4 and are guided in a door sill 5 at the bottom edge. An abutment air gap seal 10 is attached at the upper edge of the door leaf 3 and a vertically extending post air gap seal 7 is attached at a rear edge of the door leaf 3. A sill air gap 11 exists between the bottom edge of the door leaves 3 and an upper surface of the door sill 5.

Figure 2:
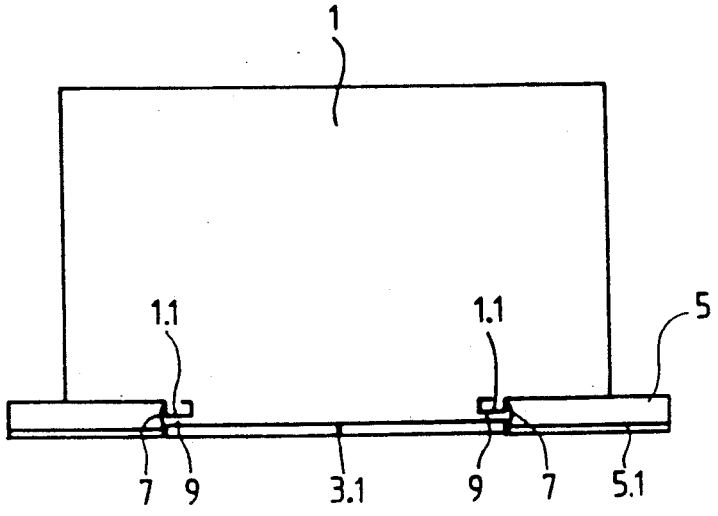
FIG. 2 is a cross-sectional view of the elevator car taken along the line 2—2 in the FIG. 1.

The FIG. 2 is an horizontal cross-sectional view of the elevator car 1 showing a side post 1.1 on each side of the car entryway having the post seal 7 attached thereto. The door sill 5 includes a guide groove 5.1 extending across the width thereof. A door air gap 9 exists between the inner surface of the door leaves 3 and the fixed portions of the front wall of the car 1.

Figure 3:
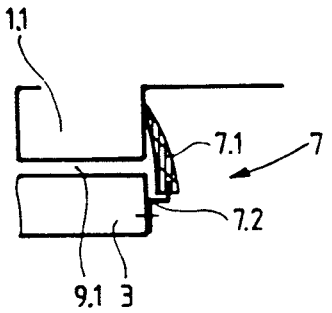
FIG. 3 is an enlarged fragmentary view of a post air gap seal shown in the FIG. 2.

The FIG. 3 is enlarged to show the details of the post seal 7. The seal 7 includes a seal carrier 7.2 fastened to the rear edge of the door adjacent to the post 1.1 when the door leaves 3 are in a closed position. An elastic sealing strip 7.1 is mounted on the carrier 7.2 to close a post air gap 9.1 between the inner surface of the door leaf 3 and a facing surface of the post 1.1.

Figure 4:
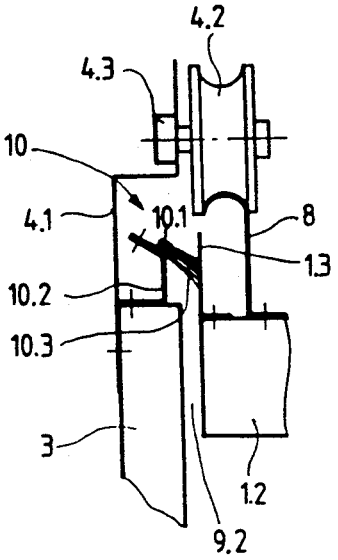
FIG. 4 is an enlarged fragmentary view of an upper door abutment air gap seal shown in the FIG. 1.

In the FIG. 4, the abutment seal 10 is shown, which seal includes an horizontally extending seal carrier 10.2 fastened at the upper edge face of the door leaf 3. The seal carrier 10.2 has a generally U-shaped cross section with a straight leg extending horizontally and attached to the upper edge of the door leaf 3,a generally vertically extending center section positioned adjacent a rear surface of the door leaf and an angled leg extending upwardly and outwardly toward a front surface of the door leaf. A bristle carrier 10.1 is attached to the seal carrier 10.2 and mounts a row of bristles 10.3 which lie against a vertically extending surface of an angle bracket 1.3. The angle bracket 1.3 is attached to a horizontal upper surface of a stop 1.2 attached to a lower surface of the rail 8. An abutment air gap 9.2 is formed between the facing surfaces of the door leaf 3 and the stop 1.2. The air gap 9.2 is closed from above by the sliding abutment seal 10 which moves with the door leaf 3. The door leaf hangers 4 each include a support 4.1 attached at a lower end to the outer surface of the door leaf 3 and retaining at an upper end a roller pin 4.3. A roller 4.2 is rotatably mounted on each of the roller pins 4.3 and runs on the rail 8.

Figure 5:
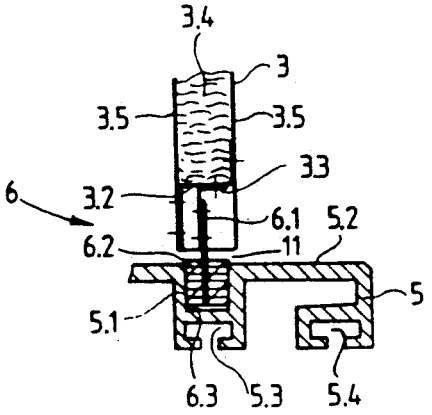
FIG. 5 is an enlarged fragmentary cross-sectional view of a door sill air gap seal at the underside of the door shown in the FIG. 1.

The FIG. 5 is a cross-sectional view which shows the details of the door sill seal 6. A carrier bracket 3.3 is attached by a shorter leg to the bottom edge of the door leaf 3 at the attachment of an horizontal center section of a double-angled internal spacer 3.2. A sealing plate 6.1, which in turn carries a groove-filling guiding slide member 6.2, is mounted on a longer leg of the carrier bracket 3.3. The door sill 5 has an upwardly facing tread surface 5.2 with a guide groove 5.1 formed therein. The groove 5.1 is not filled completely to the bottom by the guiding slide member 6.2 and the sealing plate 6.1 so that an intermediate space 6.3 remains at the bottom of the groove and the slide member 6.2 slidably engages the walls of the groove. A T-shaped groove 5.3 is formed underneath the guide groove 5.1 and the right-hand portion of the sill 5 extends downwardly and also has a T shaped groove 5.4 formed therein. The door leaf 3 has spaced apart outside walls 3.5 and a space between the walls is filled with a sound-damping material 3.4.

Figure 6:
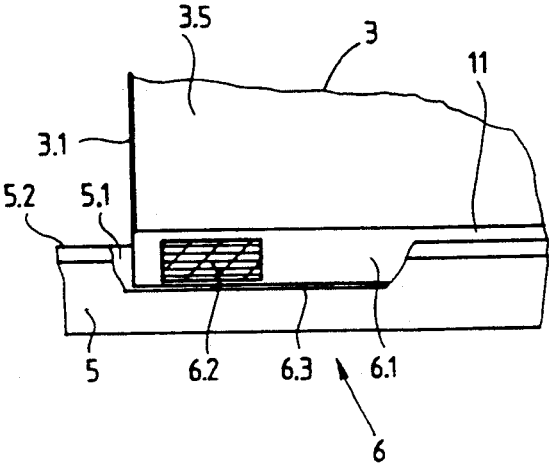
FIG. 6 is an enlarged partial front elevational view of the door sill air gap seal shown in the FIG. 5.

The FIG. 6 shows the sill seal 6 in side elevation. A portion of the door sill 5 is broken away to expose the continuous sealing plate 6.1 and the guiding slide member attached thereto. Also shown, between the bottom of the groove 5.1 and lower edge of the sealing plate 6.1, is the intermediate space 6.3 which is of constant depth over the entire length of the groove. The sill air gap 11 is also shown between the tread surface 5.2 and the lower edge of the outside wall 3.5 of the door leaf 3. The front door edge air gap seal 3.1 is shown attached to the front edge of the door leaf 3.

Figure 7:
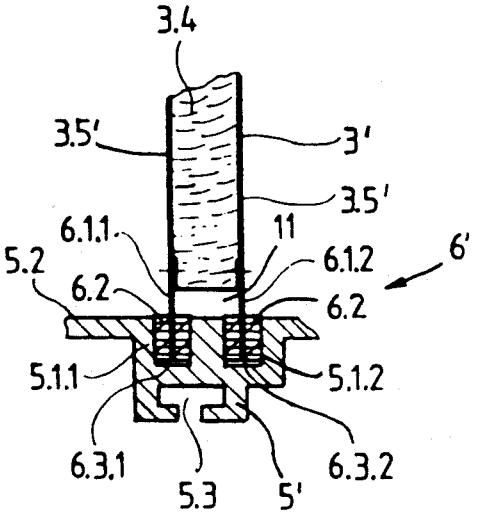
FIG. 7 is an enlarged fragmentary cross-sectional view of an alternate embodiment of the door sill air gap seal shown in the FIG. 5 having a double seal.

The FIG. 7 shows in an alternate embodiment the principle of a double seal as a door sill air gap seal 6'. A pair of outside walls 3.5' of a door leaf 3' are extended downwardly at the lower edges to each form one of a pair of spaced sealing plates 6.1.1 and 6.1.2 on which a pair of the guiding slide members 6.2 are mounted. A door sill 5' has a tread surface 5.2, a first guide groove 5.1.1 and a second groove 5.1.2. A guiding slide member 6.2 is positioned in each of the grooves 5.1.1 and 5.1.2 and the slide members define intermediate spaces 6.3.1, and 6.3.2 respectively at the bottoms of the grooves.

Figure 8:
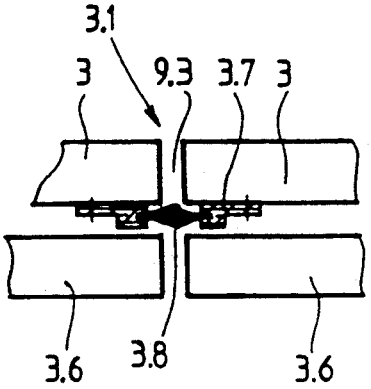
FIG. 8 is an enlarged fragmentary cross sectional view of a front door edge air gap seal shown in the FIG. 1.

The FIG. 8 shows the details of the vertically extending front door edge air gap seals 3.1. The seals 3.1 are mounted in the intermediate space between the vertically extending and facing surfaces of a pair of shaft door leaves 3.6 and the car door leaves 3. The seals 3.1 are positioned on the outer surfaces of the door leaves 3 and extend in front of an air gap 9.3 between the facing front edges of the car door leaves. Each of the seals 3.1 includes a bristle carrier 3.7 attached to the door leaf 3 and a row of bristles 3.8 mounted on the carrier. When the door is closed, the rows of bristles 3.8 interpenetrate mutually and thereby effect a sound-obstructing closure across the air gap 9.3.

The acoustical sealing apparatus described above operates as follows: In order to accommodate mechanical differences, four different types of dynamic seals are used on the door leaves 3. Namely, a vertically extending post seal 7 having an elastic sealing strip 7.1 for the rear door edge, an horizontally extending sliding bristle 10.3 for the abutment seal 10 at the top door edge, an horizontally extending labyrinth sealing plate 6.1 for the sill seal 6 at the bottom door edge and a vertically extending front door edge seal 3.1 with contact bristles 3.8 for the front edge.

The post seal 7 has a soft elastic sealing strip 7.1 which, in the closed setting of the elevator door, lies fully against the side surface of the side post 1.1. The elastic bias and thereby the contact pressure of the sliding bristles 10.3 of the abutment seal 10 is relatively small and makes no special demands on the bristle material and the sliding contact surface.

The sill seal 6 is constructed as a labyrinth seal. The sealing plate 6.1, which is continued over the entire width of a door leaf 3, leaves only a quite small gap of, for example, 0.5 to one millimeter free (intermediate space 6.3) in the bottom of the guide groove 5.1. Sound waves entering from the outside must make a U-shaped detour and slip through the intermediate space 6.3 and while being partially absorbed by the hollow lower part of the door leaf 3 (FIG. 5). A practically complete barrier to sound waves in achieved by the double seal shown in the FIG. 7. In that embodiment, two labyrinth seals are located one behind the other, thus in series.

All four sealing systems (3.1, 6, 7, and 10) together completely cover the respective air gaps (9.3, 11, 9.1 and 9.2) present in an automatic door and, when the door is closed, prevent outside noises from penetrating into the interior of the car. The front door edge seal 3.1 closes the front door edge air gap 9.3 from the top to the bottom of the door leaf 3, the door sill seal 6 closes the sill air gap 11 from the front edge to the rear edge of the door leaf, the post seal 7 closes the post air gap 9.1 from the bottom to the top of the door leaf and the abutment seal 10 closes the entire abutment air gap 9.2 from the rear edge to the front edge of the door leaf.

The principle of the labyrinth seal for the sill seal 6 is preferred over a contacting seal for the reason that dirt and foreign bodies of all kinds are present and must be accommodated within this region The effect of the sill seal 6 is increased, even apart from the doubling according to the FIG. 7, when the guiding slide members 6.2 are lengthened and/or increased in number.

Figure 9:
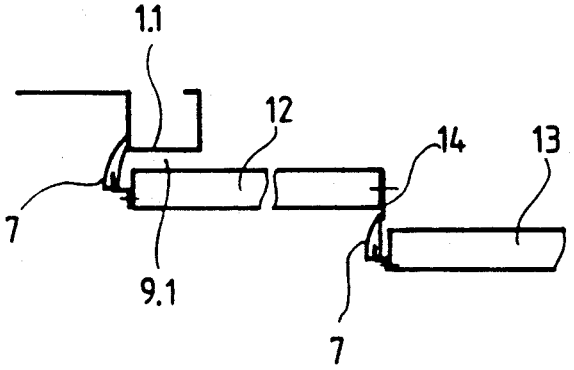
FIG. 9 is a fragmentary cross sectional plan view of a telescopic door utilizing a pair of post air gap seals in accordance with the present invention.

Another alternate embodiment is shown in the FIG. 9 wherein the present invention is adapted to telescopic doors. The abutment seal 10, the post seal 7 and the sill seal 6 must each be duplicated for the additional door leaf in each door half. The second post seal 7 is mounted on the rear edge of an outer door leaf 13. In the closed position of the door, the additional post seal 7 on the outer door leaf 13 abuts a laterally protruding metal sealing plate 14 which is mounted at the front edge of an inner door leaf 12. Both the upper and lower sealing systems 10 and 6 are mounted on the outer door leaf 13 and on the inner door leaf 12 exactly the same as for the single door and are, therefore, not illustrated.

The principle of the aforedescribed combined sealing systems applies also to automatic and manually actuated sliding doors on road and rail vehicles.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for sealing automatically actuated elevator car doors against the penetration of sound from outside the car, the car doors having horizontally moved door leaves which are guided and suspended by rollers and a rail at a top edge and guided by sliding guide members in a groove formed in a door sill at a bottom edge, and wherein the door leaves are moved by a door drive, the apparatus comprising: a plurality of dynamic sound proofing seals, each said seal attached in a fixed relationship to an associated edge of an elevator car door leaf and adapted to close one of a sill air gap, an abutment air gap, a post air gap and a front door edge air gap when said door leaf is in a closed position in an elevator car entryway.

2. The apparatus according to claim 1 wherein one of said seals is a door sill seal including at least one sealing strip extending across the entire width of the door leaf and adapted to extend downwardly into a groove formed in a door sill, and a guiding slide member attached to said one sealing strip and adapted to slidably engage walls of the groove, said sealing strip forming a labyrinth seal and adapted to close the sill air gap.

3. The apparatus according to claim 2 wherein the door leaf has a pair of spaced apart outside walls which extend downwardly at lower edges thereof, each of said lower edges forming one of a pair of said sealing strips, and including a guiding slide member attached to each of said sealing strips and adapted to slidably engage walls of an associated groove formed in the door sill, said pair of sealing strips forming a double labyrinth seal.

4. The apparatus according to claim 1 wherein one of said seals is a door sill seal including a pair of sealing strips, said door leaf having a pair of spaced apart outside walls which extend downwardly at lower edges thereof to form said sealing strips, said pair of sealing strips forming a double labyrinth seal.

5. The apparatus according to claim 1 wherein one of said seals is an abutment seal having a row of bristles fastened on an upper edge of the door leaf and adapted to slide on a surface of the car, said abutment seal adapted to close the abutment air gap.

6. The apparatus according to claim 1 wherein one of said seals is a post seal having an elastic sealing strip fastened at a rear edge of the door leaf and adapted to abut a side post of the car, said post seal adapted to close the post air gap.

7. The apparatus according to claim 1 wherein one of said seals is a door edge seal having a row of bristles fastened on a front edge of the door leaf and adapted to interpenetrate bristles of a door edge seal fastened to an associated door leaf when said door leaves are in a closed position of the elevator door, said door edge seal adapted to close the front door edge air gap.

8. An apparatus for sealing automatically actuated elevator car doors against the penetration of sound from outside the car when the car doors are closed, the car doors having horizontally moved door leaves which are guided and suspended in an elevator car entryway, comprising:

a door sill seal including at least one sealing strip extending across the entire width of a door leaf and adapted to extend downwardly into a groove formed in a door sill, and a guiding slide member attached to said one sealing strip and adapted to slidably engage walls of the groove, said sealing strip forming a labyrinth seal and adapted to close a sill air gap;

an abutment seal having a row of bristles fastened on an upper edge of the door leaf and adapted to slide on a surface of the car, said abutment seal adapted to close an abutment air gap;

a post seal having an elastic sealing strip fastened at a rear edge of the door leaf and adapted to abut a side post of the car, said post seal adapted to close a post air gap; and a door edge seal having a row of bristles fastened on a front edge of the door leaf and adapted to interpenetrate bristles of a door edge seal fastened to an associated door leaf when said door leaves are in a closed position of the elevator door, said door edge seal adapted to close a front edge air gap.

9. The apparatus according to claim 8 wherein the door leaf has a pair of spaced apart outside walls which extend downwardly at lower edges thereof, each of said lower edges forming one of a pair of said sealing strips, and including a guiding slide member attached to each of said sealing strips and adapted to slidably engage walls of an associated groove formed in the door sill, said pair of sealing strips forming a double labyrinth seal.

10. An elevator car having automatically actuated elevator car doors for closing an entryway, comprising:

a car door including a pair of horizontally moved door leaves which are guided and suspended at a top edge by rollers and a rail attached to an elevator car and guided at a bottom edge by sliding guide members in a groove formed in a door sill of the elevator car, and wherein said door leaves are moved by a door drive mounted on the elevator car; and a plurality of dynamic sound proofing seals, each said seal fixedly attached to an associated edge of one of said elevator car door leaves and adapted to close one of a sill air gap, an abutment air gap, a post air gap and a front door edge air gap when said door leaves are in a closed position in the elevator car entryway.

11. The apparatus according to claim 10 wherein one of said seals is a door sill seal including at least one sealing strip extending across the entire width of said door leaves and adapted to extend downwardly into the groove formed in the door sill, and a guiding slide member attached to said one sealing strip and adapted to slidably engage walls of the groove, said sealing strip forming a labyrinth seal and adapted to close the sill air gap.

12. The apparatus according to claim 10 wherein one of said seals is a door sill seal including a pair of sealing strips each extending across the entire width of said door leaf and adapted to extend downwardly into an associated groove formed in a door sill, and a guiding slide member attached to each said sealing strip and adapted to slidably engage walls of said associated groove, said door leaf having a pair of spaced apart outside walls which extend downwardly at lower edges thereof to form said sealing strips, said pair of sealing strips forming a double labyrinth seal and serving as sill seal for said door leaf.

13. The apparatus according to claim 10 wherein one of said seals is an abutment seal having a row of bristles fastened on an upper edge of said door leaf and adapted to slide on a surface of the car, said abutment seal adapted to close the abutment air gap.

14. The apparatus according to claim 10 wherein one of said seals is a post seal having an elastic sealing strip fastened at a rear edge of said door leaf and adapted to abut a side post of the car, said post seal adapted to close the post air gap.

15. The apparatus according to claim 10 wherein one of said seals is a door edge seal having a row of bristles fastened on a front edge of said door leaf and adapted to interpenetrate bristles of a door edge seal fastened to the other one of said pair of door leaves when said door leaves are in a closed position of the elevator door, said door edge seal adapted to close the front door edge air gap.

* * * * *